United States Patent [19]

Kojima

[11] 4,170,890

[45] Oct. 16, 1979

[54] PUNCH AND DIE ASSEMBLY FOR USE IN THE PRODUCTION OF HEAT EXCHANGER FINS

[75] Inventor: Toyoo Kojima, Tokyo, Japan

[73] Assignee: Hidaka Engineering Company, Limited, Tokyo, Japan

[21] Appl. No.: 923,937

[22] Filed: Jul. 13, 1978

[30] Foreign Application Priority Data

Apr. 7, 1978 [JP] Japan ..... 53-40227

[51] Int. Cl.[2] ..... B21D 22/00

[52] U.S. Cl. ..... 72/359; 72/335; 72/370; 72/482

[58] Field of Search ..... 72/359, 482, 360, 370, 72/335, 339; 83/699

[56] References Cited

U.S. PATENT DOCUMENTS

| | | | |
|---|---|---|---|
| 2,367,121 | 1/1945 | Hill | 72/327 |
| 3,012,664 | 12/1961 | Singleton | 72/263 |
| 3,412,593 | 11/1968 | Price | 72/33 J |
| 4,084,422 | 4/1978 | Zilges | 72/265 |
| 4,098,108 | 7/1978 | Kojima | 72/358 |

*Primary Examiner*—Leon Gilden

[57] ABSTRACT

A punch and die assembly for use in the production of heat exchanger fins comprising: a fixed lower tool holder including an ironing punch having the same dimension as a predetermined flanged aperture, and a movable upper tool holder having a die matching said ironing punch, wherein said punch is allowed to displace horizontally and can always be held concentrically to the die without requiring any particular adjustment and whereby uniform products can be continuously obtained.

9 Claims, 17 Drawing Figures

PUNCH AND DIE ASSEMBLY FOR USE IN THE PRODUCTION OF HEAT EXCHANGER FINS

BACKGROUND OF THE INVENTION

This invention relates to a method and a punch/die assembly for use in the production of heat exchanger fins as in, for example, air conditioners for rooms and motor vehicles and, in particular, to an assembly wherein an ironing punch is correctly maintained in a predetermined state during the ironing process.

In general, the cooling fins are constituted by a number of superposed square aluminium sheets each having a multiple number of flanged apertures in registration with similar flanged apertures in the overlying and underlying sheets, and a number of copper tubes passed through the respective flanged apertures. The flanges are usually turned outwardly to form reflaring around the marginal edges of the apertures for the purpose of maintaining a predetermined clearance between the adjacent apertures and at the same time for reinforcing purposes. Therefore, the flanges are required to have at least projecting and curling height by more than 1.8 mm.

Referring to FIG. 1 of the accompanying drawings, in forming a flanged aperture in an aluminum sheet 1, it has been the conventional practice to perforate in the first step an aperture 2 which has a diameter far smaller than that of a flanged aperture 4 to be ultimately formed, pressing the marginal edge portions upwardly by means of a punch 3 thereby forming the flanged aperture of the predetermined dimension. However, where the aperture 2 is formed in a small diameter in an attempt to increase the height of the ultimate flange, cracking often occurs to the marginal edge portions of the aperture when pressed by the punch. Therefore, without a preliminary treatment or machining, it has been difficult to form a flange which has a height greater than 1.8 mm.

The pre-machining usually includes pressing of the coiled aluminum material 1 by a punch to form a bonnet-like recess 5 of a diameter far larger than that of the intended flanged aperture, as shown in FIG. 2(A), and further pressing of the recessed portion 5 by another punch 6 to reduce its diameter while increasing its height as shown particularly in FIG. 2(B). These operations are repeated to obtain a number of flanged apertures 4 of the predetermined diameter and height as shown in FIG. 1. This method is generally referred to as "drawing" and is capable of forming a flange of a relatively great height by the gradual or progressive stretching of the coiled aluminum material 1. However, the just-mentioned method has inherent drawbacks in that the circumferential wall of the flanged aperture 4 bears concentric hammered marks as a result of the repeated punching operation and wrinkles appear at both ends of the coiled aluminum material 1 to cause warping or distortion to the fins as a whole.

Concerning the above-mentioned problems, the inventor of the present application developed a forming method (refer to U.S. Patent Application Ser. No. 604,306 filed on Aug. 13, 1975) which comprises: the first process of perforating a small aperture at a predetermined position of coiled aluminum material, without the aforementioned pretreatment, while simultaneously forming a perpendicularly projecting cylinder of a diameter smaller than that of the flanged aperture to be ultimately formed, and the second process of burring ironing the perpendicularly projecting cylinder into a predetermined dimension with use of a punch of a predetermined size.

In FIG. 3(A), a small aperture 11 is perforated in the coiled aluminum material in the form of a sheet 1 by means of a punch 7. As a punch 9 is urged into a die 8, a relatively short cylinder 10 is formed around the small aperture 11 in the coiled aluminum material which is held against the lower surface of the die 8, as shown in FIG. 3(B). The coiled aluminum material 1, placed between another die 12 and a punch 13 which is designed to have a size conforming with the die 12 is pressed into the die 12 to form the perpendicular cylinder 10 into a flange 14 of a predetermined height as illustrated in FIGS. 3(C), 3(D) and 3(E).

In the actual operation, the aforementioned first and second process are carried out with use of a set of dies 8 and 12 and a set of punches 9 and 13 which are supported on a punch/die assembly 40, as shown FIGS. 4 and 5. The punch and die assembly 40 comprises an upper tool holder 16 and a lower tool holder 15 having integrally therewith a stripper plate 18 which is constantly urged upwardly by springs within a guide frame 17. The upper and lower tool holders 16 and 15 of the punch and die assembly 40 are mounted on a suitable press machine such that the upper tool holder 16 is pressed downwardly against spring action to effect the aforementioned first and second punching operations. More particularly, the upper tool holder 16 has the die 8 for the first punching operation and the die 12 for the second punching operation mounted thereon, the dies 8 and 12 being aligned in the direction of advancement of the workpiece 1 (from left to right as seen in FIG. 5) in one or a plural number of sets. The coiled aluminum material or workpiece 1 undergoes the first and second punching operations as it is moved intermittently or incrementally by means of a hitch-feeding mechanism 19 which is provided separately from the punch and die assembly 40. The just-mentioned dies 8 and 12 and the punches 9 and 13 are preferably provided in a plural number and arrayed, respectively, in the lateral direction (in the direction perpendicular to the workpiece feeding direction) to simultaneously form a plural number of laterally aligned flanged apertures 14 in relation with the intermittent movement of the workpiece 1. The hitch-feeding mechanism 19 in the coiled aluminum material is driven in timed relation with the reciprocating movement of the upper tool holder 16.

According to the method as shown in FIGS. 3(A-)-(E), a small perpendicularly projecting cylinder 10 is formed by a punch 7 in the first process at a desired position on the coiled aluminum material 1, and in the second process, the perpendicularly projecting cylinder 10 is further pressed out by a punch 13. In this instance, the upper circumferential portions of the perpendicularly projecting cylinder 10 is deformed by the punch 13, during the process as shown in FIGS. 3(C)-3(D), but with only a reduced tensioning stress, so that a perpendicular flange 14, which has a height of 2.8 mm in the particular embodiment shown, may be formed without difficulty and at the same time without causing cracking or other problems. However, there poses a problem. That is, in the forming steps shown in FIGS. 3(C), (D), and (E), a spacing between the die 12 and the punch 13 must be invariably fixed in every area thereof so that the marginal edge portions of the perpendicularly projecting cylinder 10 can be formed to have equal height, namely the center of the punch 13 must correctly be consistent with the center of the die 12. If these are disposed eccentrically towards one side, the peripheral walls of the perpendicularly projecting cylinder 10 are not formed to have equal height due to the change in wall thickness, but rather formed into a diagonally cut edge which inclines towards one side as shown in FIG. 6. For example, there occurs a difference in altitude of 0.2 mm with respect to 5/1000 mm eccentricity and therefore, this adjustment must be made precisely accurate.

SUMMARY OF THE INVENTION

It is an object of the present invention to provide a structure in which the punch can always be held concentrically to the die without requiring any particular adjustment.

In accordance with the invention, a punch and die assembly for use in the production of heat exchanger fins can be provided, which comprises:

a fixed lower tool holder including an ironing punch having the same dimension as a predetermined flanged aperture, a movable upper tool holder having a die matching the ironing punch, characterized in that there are provided a guide rod being operated such that the lower end center thereof always conforms with the central position of the die, an ironing punch being mounted and supported such that the upper part thereof can be slightly moved horizontally, a cylindrical bore positioned in either the upper end center of the ironing punch or lower end center of the guide rod, and a cylindrically projected end positioned in the other end center, whereby the movable upper tool holder and fixed lower tool holder are guided and conform with each other through the spring, die and ironing punch during operation.

DETAILED DESCRIPTION OF THE INVENTION

Figure 7:
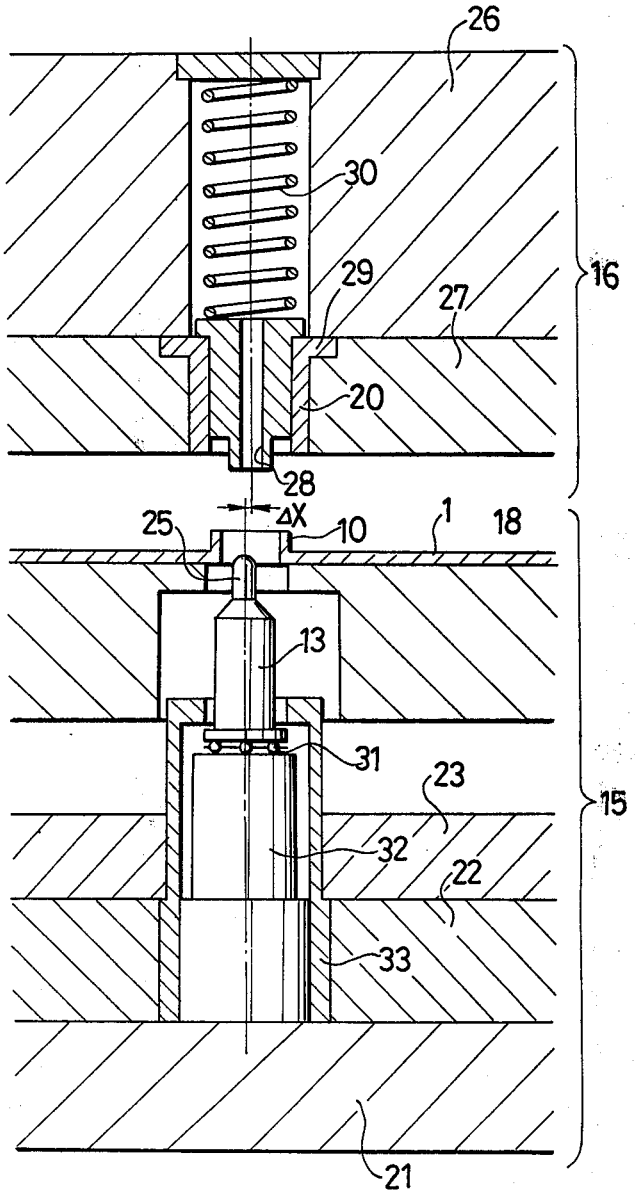
FIG. 7 is a diagrammatic sectional view illustrating an embodiment according to the present invention where an upper tool holder is moved up.

Referring to FIG. 7, the preferred embodiment of the invention will now be described.

Figure 4:
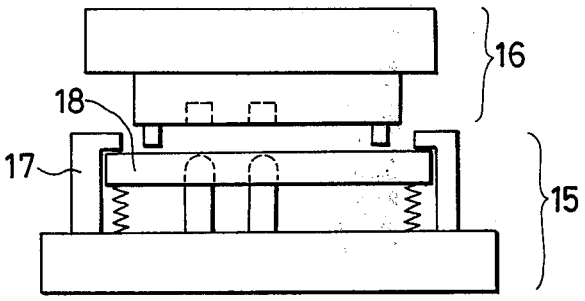
FIG. 4 is a diagrammatic front elevation of the punch and die assembly.
Figure 6:
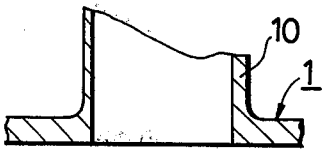
FIG. 6 is a diagrammatic sectional view illustrating a wrong example of forming a flanged aperture.
Figure 5:
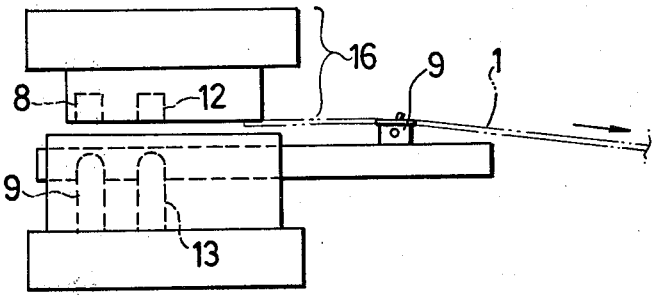
FIG. 5 is a diagrammatic side elevation of the same punch and die assembly.
Figure 9:
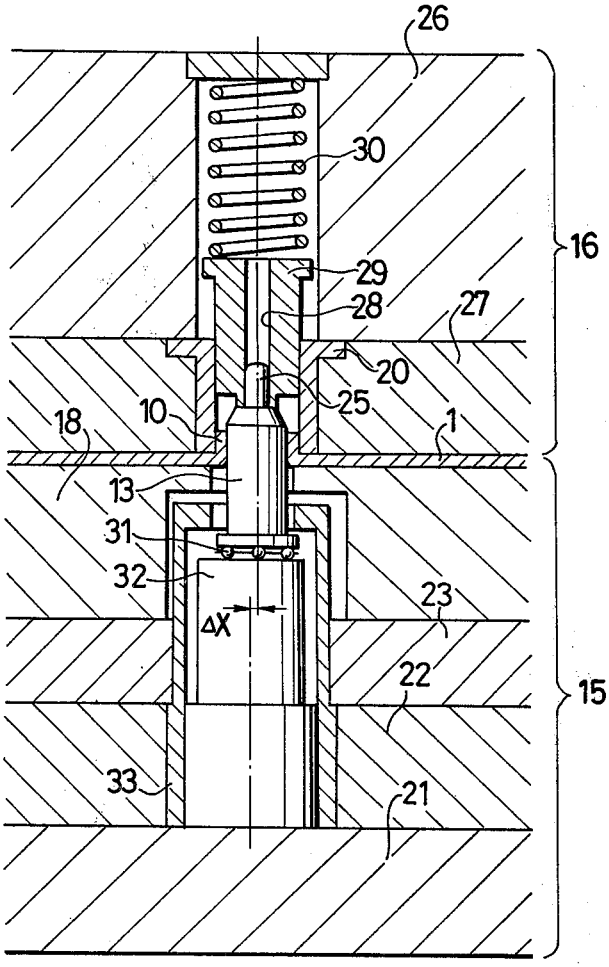
FIG. 9 is a similar to FIG. 7 where the upper tool holder is moved down.

FIG. 9 illustrates a state where an upper die is moved down. An ironing punch 13 indicated by the reference numeral common to that in FIGS. 3, 4 and 5 is coupled into an ironing bushing 20 appearing as the die 12 in FIGS. 3 and 5, and a workpiece 1 is formed with the perpendicular projecting cylinder 10.

A lower tool holder 15 comprises, from the bottom, a lower die set 21, a punch plate 22, a keep plate 23 and a stripper plate 18, which are secured to overlap each other.

The ironing punch 13 is uprightly stood with a lower inflated portion thereof with a receiver 32 and a spacing cylinder 33 coupled into the punch plate 22. Particularly, this ironing punch 13 is placed on the punch receiver 32 through means for allowing the punch to move slightly and horizontally, for example, a ball retainer 31 including plurality of balls retained freely in a horizontal plane thereof, and the upper part 33 of the ironing punch is fixed with the clearance of about 0.02 mm with respect to the diameter of the punch so that the upper part of the ironing punch 13 may have a horizontal movement slightly in the lateral direction. The ironing punch 13 has a cylindrical projection 25 of smaller diameter formed in the center of the top surface thereof.

An upper tool holder 16 comprises, from the top, an upper die set 26 and a die plate 27, which are secured to overlap each other, surrounding the ironing bushing 20. A guide rod 29 provided with a cylindrical bore 28 therein at the lower end thereof in the bore bounding on the ironing bushing 20 is coupled with the bushing 20 in such manner by which the guide rod 29 can always an exactly-downward projecting movement by a spring 30. This cylindrical bore 28 of the guide rod 29 is set in complete consistence with the central position of the ironing bushing 20.

Figure 1:
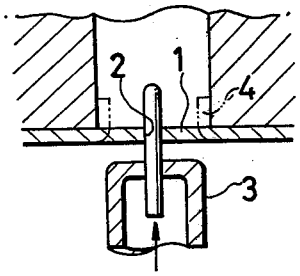
FIG. 1 PRIOR ART
FIG. 1 is a diagrammatic sectional view illustrating a conventional method of forming a flanged aperture.
Figure 2A:
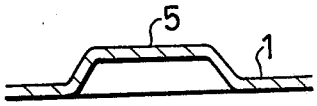
FIG. 2A PRIOR ART
FIG. 2 is a diagrammatic sectional view illustrating operational procedures in the conventional pretreatment.
Figure 2B:
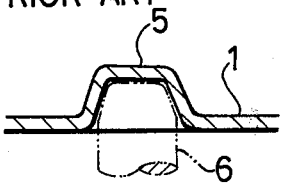
FIG. 2B PRIOR ART
Figure 3A:
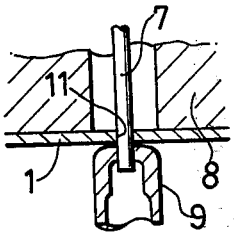
FIG. 3A PRIOR ART
FIGS. 3(A) to (E) are diagrammatic sectional views illustrating a conventional method of forming a flanged aperture.
Figure 3B:
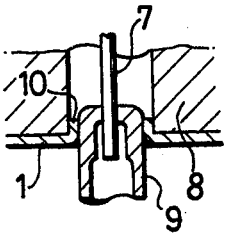
FIG. 3B PRIOR ART
Figure 3C:
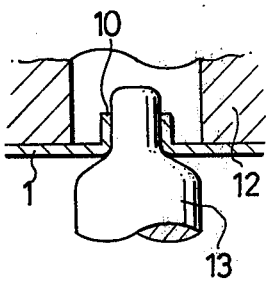
FIG. 3C PRIOR ART
Figure 3D:
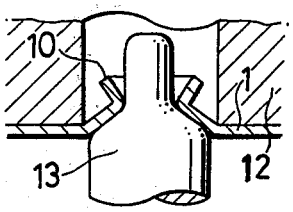
FIG. 3D PRIOR ART
Figure 3E:
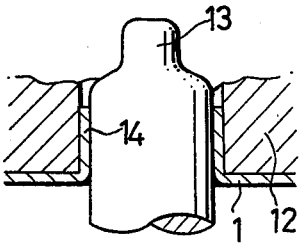
FIG. 3E PRIOR ART
Figure 8:
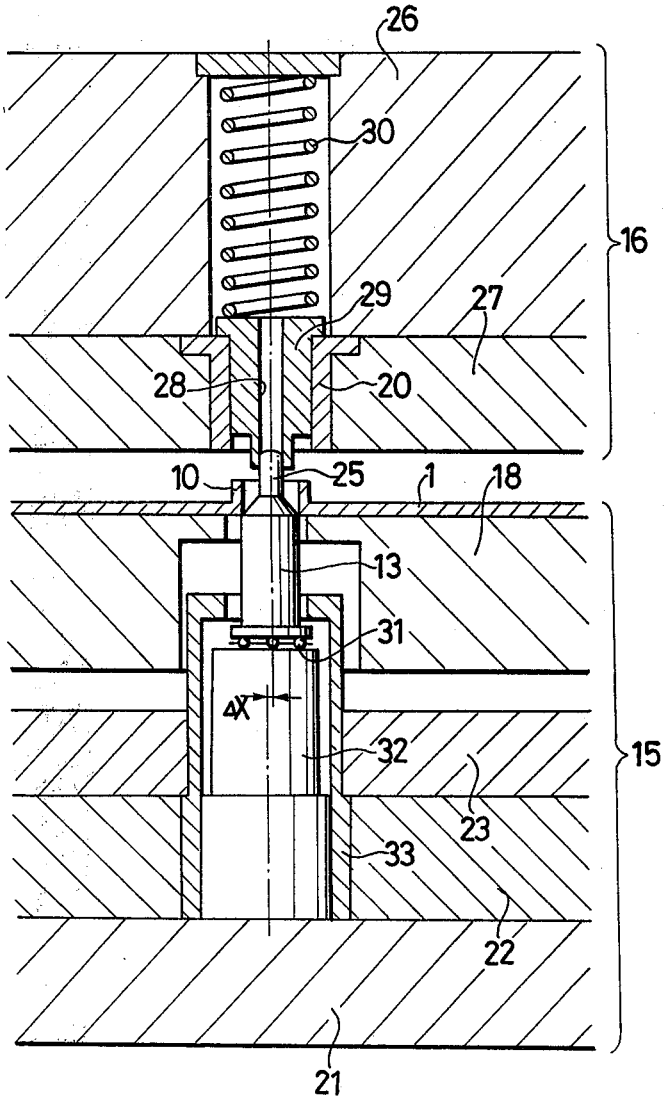
FIG. 8 shows a state ready for start the ironing operation where an ironing punch is aligned with the center line of a die by horizontal displacement thereof.
Figures 10A, 10B, 10C:
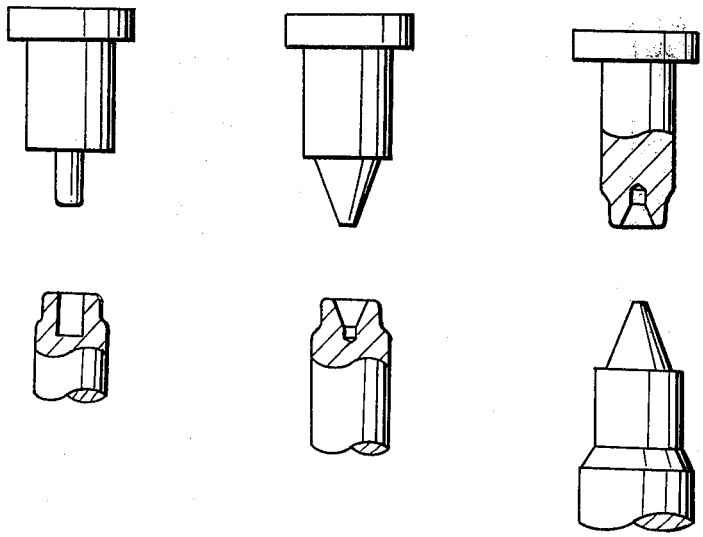
FIGS. 10A, 10B and 10C are other arrangements and configulations of combinations of the guide rod and the punch.

The device of the present invention is constructed as described above and ironing as the second step shown in FIGS. 3(C), and (D) and (E) may be accomplished while the ironing punch 13 is always accurately held concentrically within the ironing bushing 20. In a state prior to forming as shown in FIG. 7, the guide rod 29 is projected by a spring 30 with the bore 28 appearing downwardly. When the workpiece 1 is fed and the upper tool holder 16 is moved down as shown in FIG. 8, the cylindrical projection 25 in the top of the ironing punch 13 enters into the bore 28 and since both the projection 25 and the bore 28 both formed in the matching coaxial surface, the ironing punch 13 is guided uprightly and smoothly while horizontal play-moving by $\Delta x$ within the clearance between the punch and the ironing bushing 20 and correctly be held in the center of ironing bushing 20 to form the workpiece 1 into the desired shape. It will of course be understood that the same effect can be achieved by setting positions of the projection 25 and the bore 28 each other in the above connection, that is by setting the punch 13 fixedly while setting the guide rod horizontally movable. Further, the reversed arrangement of the punch and the guide rod, that is the guide rod is having a projection and the punch having a bore, and it may be taken the same effect as above mentioned arrangements by giving a conical concave hole and a pointed end to the guide rod and the punch respectively, and vice versa (FIGS. 10-A, -B and -C).

In accordance with the present invention, as described above, the ironing punch 13 may automatically be corrected in position by an extremely simple procedure to continuously obtain uniform products.

What is claimed is:

1. A punch and die assembly for use in the production of heat exchanger fins comprising:

a fixed lower tool holder including an elongated ironing punch having the same dimension as a predetermined flanged aperture, said ironing punch being loosely mounted in and supported by said tool holder such that the upper part of said ironing punch can slightly move horizontally with respect to said lower tool holder, a movable upper tool holder having an elongated die matching said ironing punch, an elongated guide rod coupled to movable with said upper tool holder whereby the longitudinal axis of the lower end of said guide rod is always coincidental with the axis of the die, a spring normally urging said guide towards said lower tool holder, a cylindrical bore end provided in either the upper end center of said ironing punch or lower end center of said guide rod, a cylindrical projected end positioned in the other end center and adapted to be matchingly received in said bore, and a retainer ring arranged between said ironing punch and a punch receiver, whereby said ironing punch and said guide rod are guided and cooperate with each other through said spring allowing the horizontal movement of said ironing punch during operation of said punch and die assembly.

2. A punch and die assembly as claimed in claim 1, wherein said ironing punch has a cylindrically projected end and said guide rod has a cylindrical bore therein matching said cylindrically projected end provided at the lower end center thereof.

3. A punch and die assembly as claimed in claim 1, wherein said ironing punch has a cylindrical bore therein at the upper end center thereof and said guide rod has a cylindrically projected end provided at the lower end center thereof matching said bore.

4. A punch and die assembly as claimed in claim 1, wherein said ironing punch has a conical projected end provided at the upper end center thereof and said guide rod has a conical recessed aperture matching said conical projected end provided at the lower end center thereof.

5. A punch and die assembly as claimed in claim 1, wherein said ironing punch has a conical recessed aperture provided at the upper end center thereof and said guide rod has a conical projected end matching said conical recessed aperture provided at the lower end center thereof.

6. A punch and die assembly as claimed in claim 1, wherein said lower tool holder consists of, from the bottom, a lower die set, a punch plate, a keep plate and a stripper plate, which are secured to overlap each other.

7. A punch and die assembly as claimed in claim 1, wherein said upper tool holder consists of, from the top, an upper die set and a die plate, which are secured to overlap each other, surrounding an ironing bushing.

8. A punch and die assembly as claimed in claim 6, wherein said ironing punch is uprightly stood with a lower inflated portion thereof received into said punch plate and upon a punch receiver, and is fixed with the clearance of about 0.02 m/m in the lower tool holder so that the upper part thereof may have an inclining movement slightly in the lateral direction.

9. A punch and die assembly as claimed in claim 7, wherein the said guide rod in the bore bounding on the ironing bushing is coupled with the bushing in such manner by which the guide rod can always have an exactly-downward projecting movement by a spring.

* * * * *